United States Patent [19]

Wenz

[11] Patent Number: 5,076,119

[45] Date of Patent: Dec. 31, 1991

[54] ROOF SHINGLE REMOVER

[75] Inventor: Steven C. Wenz, Lacon, Ill.

[73] Assignees: Mary E. Wenz, Lacon, Ill.; Lee Tripp, Lincoln, Nebr.

[21] Appl. No.: 533,510

[22] Filed: Jun. 5, 1990

[51] Int. Cl.[5] ..... E04D 15/00

[52] U.S. Cl. ..... 81/45; 81/46; 30/170; 30/169

[58] Field of Search ..... 81/45, 46; 30/170, 169

[56] References Cited

U.S. PATENT DOCUMENTS

| | | | |
|---|---|---|---|
| 2,005,630 | 6/1935 | Overell | 30/170 |
| 2,874,946 | 2/1959 | Singleterry et al. | 30/170 |
| 4,683,657 | 8/1987 | Anderson et al. | 30/170 |
| 4,837,933 | 6/1989 | Chapman | 30/170 |
| 4,880,491 | 11/1989 | Jacobs et al. | 81/45 |

*Primary Examiner*—D. S. Meislin
*Assistant Examiner*—Lawrence Cruz
*Attorney, Agent, or Firm*—Emrich & Dithmar

[57] ABSTRACT

Apparatus for removing an outer layer, or covering, such as of shingles from a flat surface such as a roof includes a frame with an elongated, linear cutting blade attached to a lower, forward portion thereof and adapted for displacement along and in contact with the roof. The apparatus further includes a blade drive arrangement for displacing the blade in a reciprocating manner along its length and parallel to the roof. Also attached to a forward portion of the frame immediately above the blade is a concave, upward extending deflector for directing the removed shingles forward of the apparatus as it is displaced over the roof. A handle extends from the frame to facilitate manual displacement of the apparatus over the roof as the roofing nails, or other attachment means, are served by the blade in removing the shingles from the roof. Alternative embodiments include lower skids to facilitate pushing the apparatus over the roof surface as well as wheels including a drive wheel coupled to a drive source for self-propelled operation. To facilitate displacement of the apparatus over an inclined roof, a first cable may be attached to a pulley positioned near the peak of the roof, with one end of the cable attached to the apparatus frame and its other end attached to an operator via a safety belt for preventing either the operator or apparatus from falling off of the roof and to facilitate moving the apparatus up the inclined roof.

40 Claims, 4 Drawing Sheets

ROOF SHINGLE REMOVER

BACKGROUND OF THE INVENTION

This invention relates generally to the removal of an outer layer or covering from an underlying flat surface and is particularly directed to apparatus for removing shingles from a roof.

The removal of shingles from a roof is time-consuming, labor intensive, and expensive. Shingle removal is generally accomplished by prying up the individual shingles using a pitchfork, directing the thus removed shingles down the slope of the roof using a shovel, and preparing the roof surface for a replacement layer of shingles by either removing the nails used to attach the removed shingles or driving the nails into the roof. This work is also dangerous and exhaustive.

One attempt to facilitate the removal of shingles from a roof is disclosed in U.S. Pat. No. 4,763,547 to Dike which describes a pair of jaw-like members inserted beneath a shingle which are displaced apart by pneumatic pressure for removing the shingle. While this approach appears to be easier than removing the individual shingles with a hammer or pitchfork, it requires the removal of each shingle individually and is thus slow and tedious.

The present invention addresses the aforementioned limitations of the prior art by providing apparatus for removing several roof shingles at one time by severing the roof shingle attachment means, i.e., nails or an adhesive cement, over an extended portion of the roof. The roof shingle removing apparatus may be either hand-operated or power propelled in a direction either along or down the slope of the roof. The roof shingle removing apparatus is easily operated, lightweight, and highly efficient in removing roof shingles.

OBJECTS OF THE INVENTION

Accordingly, it is an object of the present invention to provide an improved apparatus for removing an outer covering or layer affixed to a flat underlying support structure.

Another object of the present invention is to facilitate removal of a surface covering attached to a flat underlying support structure with nails or other attachment means by severing the attachment means and scraping the thus loosened covering away from the support structure.

Yet another object of the present invention is to provide a lightweight, portable, easily controlled and operated apparatus for removing shingles from a roof.

A further object of the present invention is to provide a manual or powered apparatus with a reciprocating blade for stripping a surface covering from a flat support structure to which it is affixed.

A still further object of the present invention is to substantially reduce the time required to remove a covering layer, such as of shingles, from a roof, while leaving the roof in condition for receiving a replacement covering.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DESCRIPTION OF THE PREFERRED EMBODIMENTS

Figure 1:
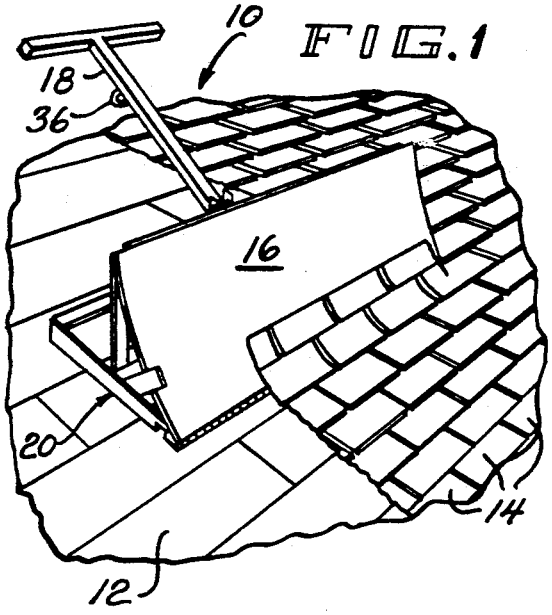
FIG. 1 is a perspective view showing a roof shingle removing apparatus in accordance with the present invention removing shingles from a roof.
Figure 2:
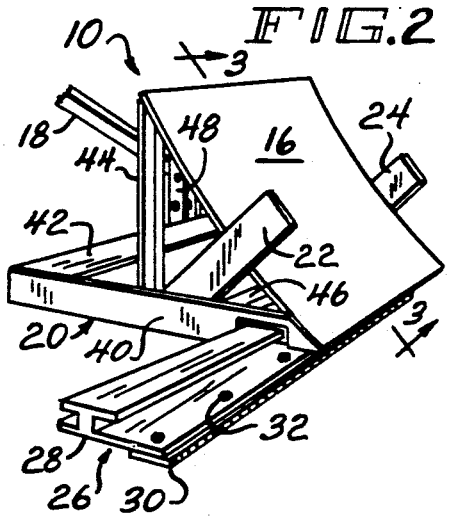
FIG. 2 is a partial side view of the roof shingle remover of FIG. 1.
Figure 3:
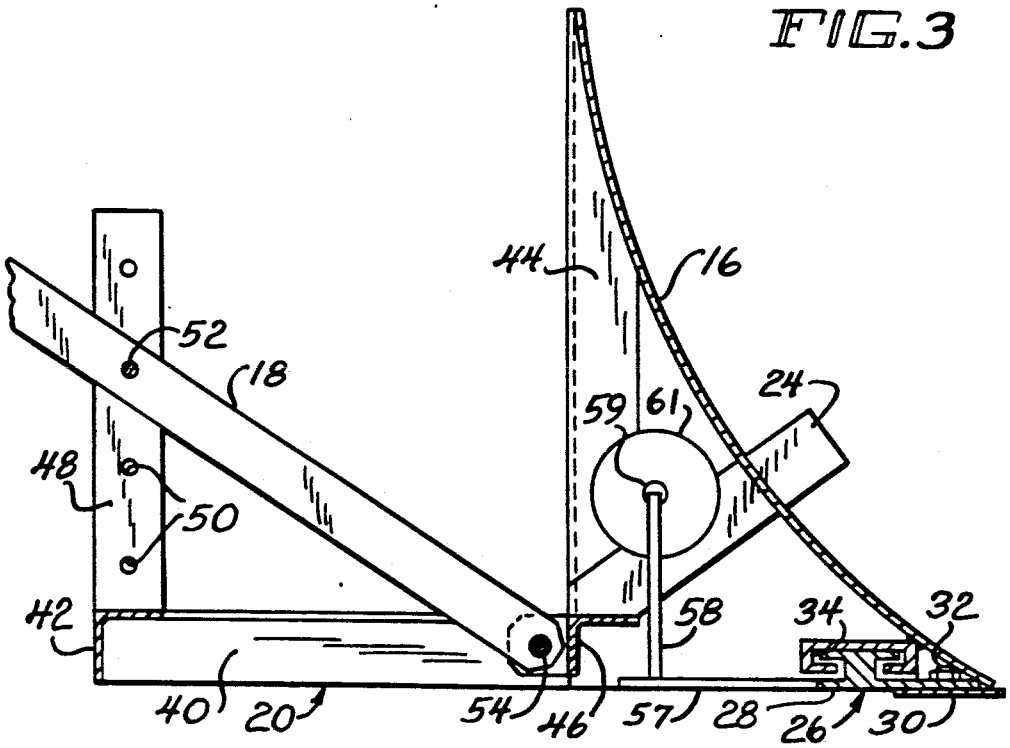
FIG. 3 is a sectional view of the roof shingle remover of FIG. 2 taken along site line 3—3 therein.

Referring to FIG. 1, there is shown a roof shingle remover 10 removing shingles 14 from a roof 12 in accordance with the principles of the present invention. Additional details of the roof shingle remover 10 are shown in the partial side view of FIG. 2 and the sectional view of FIG. 3 taken along site line 3—3 in FIG. 2.

The roof shingle remover 10 is adapted for removing shingles 14 attached to a roof 12 by conventional means such as nails or an adhesive cement. The roof shingle remover 10 includes a frame 20 comprised of a plurality of coupled structural members including a pair of upright frame members 44, a pair of side frame members 40, and an aft frame member 42 coupling the side frame members. The side frame members 40 as well as the aft frame member 42 serve as skids to support the roof shingle remover 10 on the roof 12 as it is manually displaced by means of a handle 18 coupled to the structural frame 20 in removing shingles. As shown specifically in FIG. 3, the T-shaped handle 18 is pivotally coupled to a cross-member 46 by means of a pivot pin 54. An intermediate portion of the T-shaped handle 18 is adapted for coupling to a center bracket 48 by means of a positioning pin 52 inserted through aligned apertures in the handle and center bracket. The height of the handle 18 may be selected by inserting the positioning pin 52 through an aperture in the handle as well as through an aligned aperture 50 in the center bracket 48. The height of the T-shaped handle 18 may thus be adjusted as desired by an operator of the roof shingle remover 10 depending upon operator preference and the slope of the roof. The handle 18 may be provided with a connecting loop 36 for attachment to a cable as described below to facilitate operation and handling of the roof shingle remover 10 or an inclined roof surface. Each of the structural members comprising the frame 20 is preferably comprised of a high strength, lightweight metal such as structural steel. The structural members are coupled by conventional means such as weldments so as to form a unitary structure.

Disposed on a forward portion of the structural frame 20 is an elongated, linear channel member 34 defining a slot extending the width of the frame. Inserted in the end of the channel member 34 and extending the width of the structural frame 20 is a severing assembly 26. The severing assembly 26 is inserted in tight-fitting relation within the channel member 34 and is freely displaceable along the length thereof. A conventional lubricant may be disposed within the channel member 34 and in contact with the severing assembly 26 to facilitate its linear displacement therein. The severing assembly 26 includes a displacement bar 28 to which an aft extension 57 is attached. The connecting rod 58 couples the aft extension 57 to a reciprocating motor 61 by means of a drive shaft 59. Operation of the reciprocating motor 61 causes the severing assembly 26 to be displaced in a reciprocating manner within the channel member 34. The reciprocating motor 26 may be conventional in design and operation and may be either electrically or pneumatically driven or gasoline powered.

A severing blade 30 is mounted to a forward portion of the displacement bar 28. The severing blade 30 is preferably comprised of a high strength, hard steel and includes a plurality of spaced teeth on the leading edge thereof. The blade 30 is securely attached to a forward portion of the severing assembly 26 by a plurality of spaced flathead screws 32 which are welded to a lower surface of the blade and threadably engage the severing assembly. The blade preferably is displaced in a reciprocating manner over a distance of one inch at approximately 2400 strokes per minute. The severing assembly 26 may be removed from the frame 20 by sliding the displacement bar 28 from an end of the channel member 34 after disconnecting the severing assembly from the displacement motor 61.

Disposed immediately above the severing blade 30 and attached to a forward portion of the frame 20 is a generally concave, upward and aft extending deflector 16. The deflector 16 moves the severed shingles forward and maintains them in front of the roof shingle remover 10 as it is displaced along the roof. The thus severed shingles may be easily pushed off the roof by the deflector 16 as the roof shingle remover 10 approaches an edge of the roof. The deflector 16 thus eliminates the step of collecting and disposing of the shingles after they are loosened from the roof. Disposed adjacent to respective ends of the deflector 16 and extending forward thereof are a pair of cutting elements 20 and 24. The cutting elements 20, 24 are each provided with a sharp leading edge to severe the loosened shingles which are displaced up the deflector 16 from those shingles which have not yet been severed from the roof. The cutting elements 20, 24 thus permit a shingle-less path to be cut across the roof, with adjacent layers of shingles remaining for removal during subsequent passes.

Figure 4:
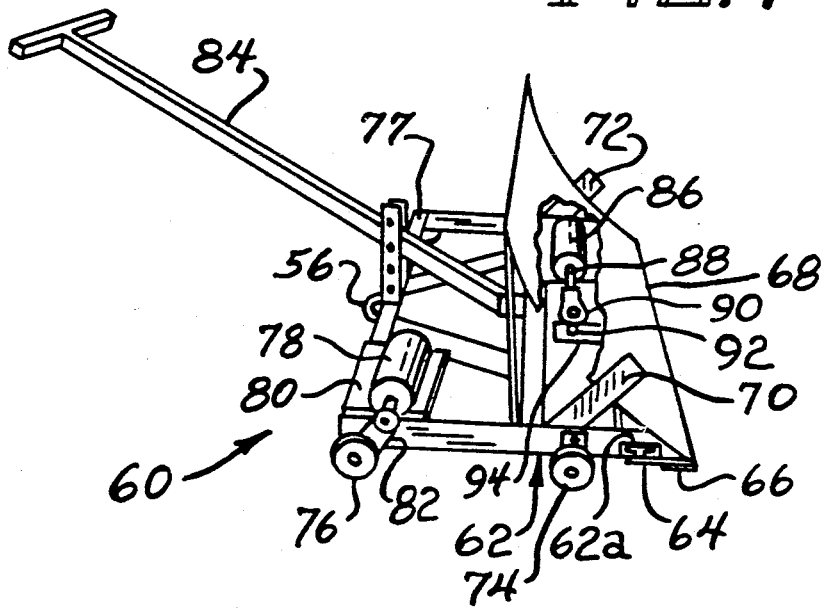
FIG. 4 is a partially cut-away side perspective view of another embodiment of a roof shingle removing apparatus in accordance with the present invention.
Figure 5:
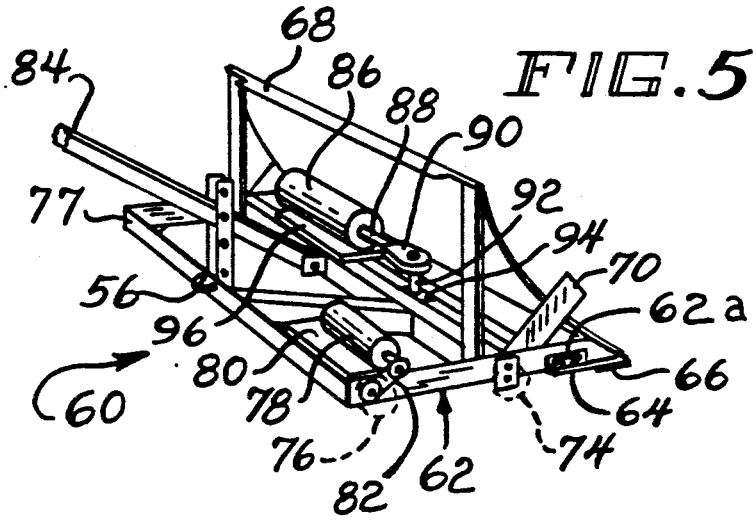
FIG. 5 is a partial perspective of an aft portion of the roof shingle removing apparatus of FIG. 4.

Referring to FIGS. 4 and 5, there are shown side and aft perspective views of a powered driven shingle remover 60 in accordance with the present invention. As in the previously described embodiment, the power driven shingle remover 60 includes a frame 62 having a generally T-shaped channel **62*a* in a forward portion thereof for receiving a displacement bar 64. Attached to a leading edge of the displacement bar 64 is a severing blade 66. The displacement bar and severing blade combination is freely displaceable along the length thereof within the T-shaped channel 62*a***.

Attached to a forward portion of the frame is a concave, upward extending shingle deflector 68 which maintains severed shingles in front of the power driven shingle remover 60 for removal from the roof. Disposed adjacent respective lateral ends of the shingle deflector 68 are first and second cutting elements 70 and 72 which severe loosened and unloosened portions of adjacent shingles permitting the power driven shingle remover 60 to cut a shingle-less swath across the surface of the roof. An adjustable handle 84 is pivotally coupled to the frame 62 to allow for adjustment of its height. A connecting loop 56 affixed to an aft cross member 77 of the frame 62 permits the power driven shingle remover 60 to be attached to a restraining system to facilitate positioning of the shingle remover apparatus as well as for increased safety as described below.

Attached to an aft portion of the displacement bar 64 is an aft extension bar 94. A displacement motor 86 is coupled to the aft extension bar 94 by means of a drive shaft 88, a coupler 90, and a connecting link 92. The displacement motor 86 is of the reciprocating type for driving the displacement bar 64 and severing blade 66 combination along its length within the T-shaped channel **62*a*. The reciprocating displacement motor 86 may be either gasoline, electrically, or pneumatically powered and may be conventional in design and operation. The displacement motor 86 is securely attached to the structural frame 62 by means of a mounting bracket 96**.

Attached to the structural frame 62 are a plurality of wheels, two of which are identified as elements 74 and 76 in the figures. It should be noted that wheels 74 and 76 are shown in dotted line form in FIG. 5 for the sake of clarity. Attached to wheel 76 by means of a drive chain and sprocket combination 82 is a drive motor 78. The drive motor 78 is securely attached to the structural frame 62 by means of a motor mounting bracket 80. The drive motor 78 rotationally displaces the drive wheel 76 via the chain and sprocket combination 82 for displacing the power driven shingle remover 60. While the displacement motor 86 is of the reciprocating type, the drive motor 78 is preferably a rotary-type motor for rotationally displacing the drive wheel 76. The drive motor 78 may also be gasoline powered or electrically or pneumatically driven.

Figure 6:
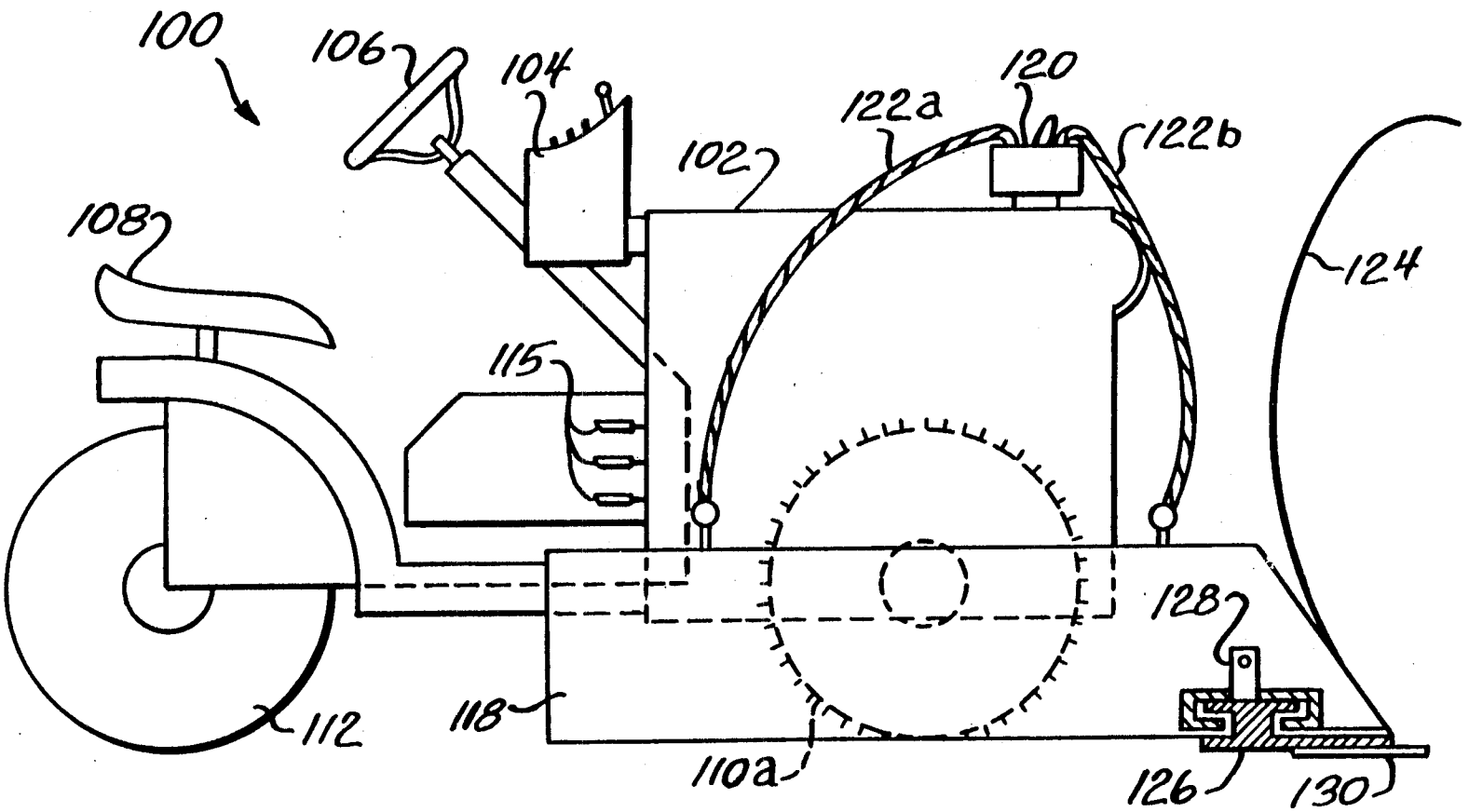
FIG. 6 is a side plan view of yet another embodiment of a roof shingle removing apparatus in accordance with the present invention.
Figure 7:
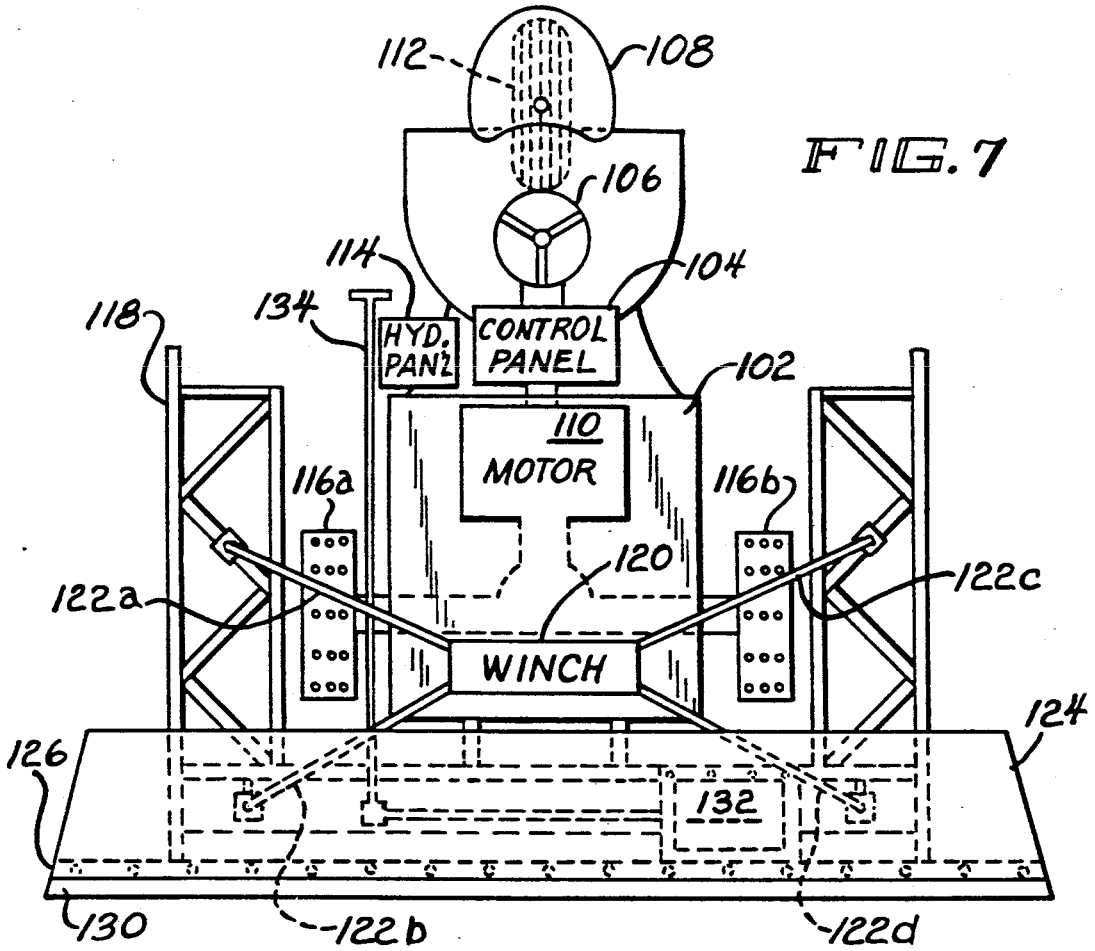
FIG. 7 is a top plan view of the roof shingle removing apparatus of FIG. 6.

Referring to FIGS. 6 and 7, there are respectively shown side and top plan views of a tractor-type shingle remover 100 in accordance with another embodiment of the present invention. The tractor-type shingle remover 100 includes a motor housing 102 enclosing a drive motor 110 for rotationally displacing a pair of forward drive wheel **116*a* and 116*b*. Each of the drive wheels 116*a*, 116*b* is provided with a plurality of studs on the outer surface thereof for securely gripping the roof surface, particularly in the case of an inclined roof. The shingle remover 100 further includes a control panel 104, a steering wheel 106, a seat 108 and an aft, steerable wheel 112 coupled by suitable linkage to the steering wheel. An operator positioned on the seat 108 has access to the control panel 104 as well as a hydraulics panel 114 and a plurality of control pedals 115 for controlling various operations of the shingle remover 100**.

Attached to the motor housing 102 by conventional means such as flexible linkage or slidably engaged coupling members (not shown for simplicity) is a positioning platform 118. The positioning platform 118 is capable of vertical displacement relative to the motor housing 102 under the control of a wench 120 and a plurality of cables 122*a*, 122*b*, 122*c* and 122*d* coupling the wench to the positioning platform 118. The wench 120 and cables permit the positioning platform 118 to be lowered under the influence of gravity to a roof engaging position as shown in the figures or to be upraised to a non-use position for transport or storage.

Attached to a forward portion of the positioning platform 118 is a generally concave, upward extending deflector 124. Also attached to a lower, forward portion of the positioning platform 118 is a displacement bar 126 which is freely moveable along its length within the positioning platform. Attached to a lower, forward portion of the displacement bar 126 is a severing blade 130, while attached to an upper portion of the displacement bar is a connecting rod 128 for coupling the displacement bar to a reciprocating displacement motor 132. Suitable control linkage 134 coupled to the displacement motor 132 allows an operator of the shingle remover 100 to control the displacement motor in actuating the shingle severing blade 130. The hydraulic panel 114 is coupled to and controls the wench 120 by suitable hydraulic linkage (not shown) for controlling the raising and lowering of the positioning platform 118 and the position of the severing blade 130. The displacement motor 132 is also mounted on the positioning platform 118 and is raised and lowered with the displacement bar 126 and severing blade 130. The cables 122*a*, 122*b*, 122*c* and 122*d* are coupled to the wench 120 and are independently adjustable for controlling the height of the forward and aft portions of the positioning platform 118 above the roof. As in the previous embodiments, the severing blade 130 is reciprocally displaced in a direction generally transverse to the direction of movement of the shingle remover 100.

Figure 8:
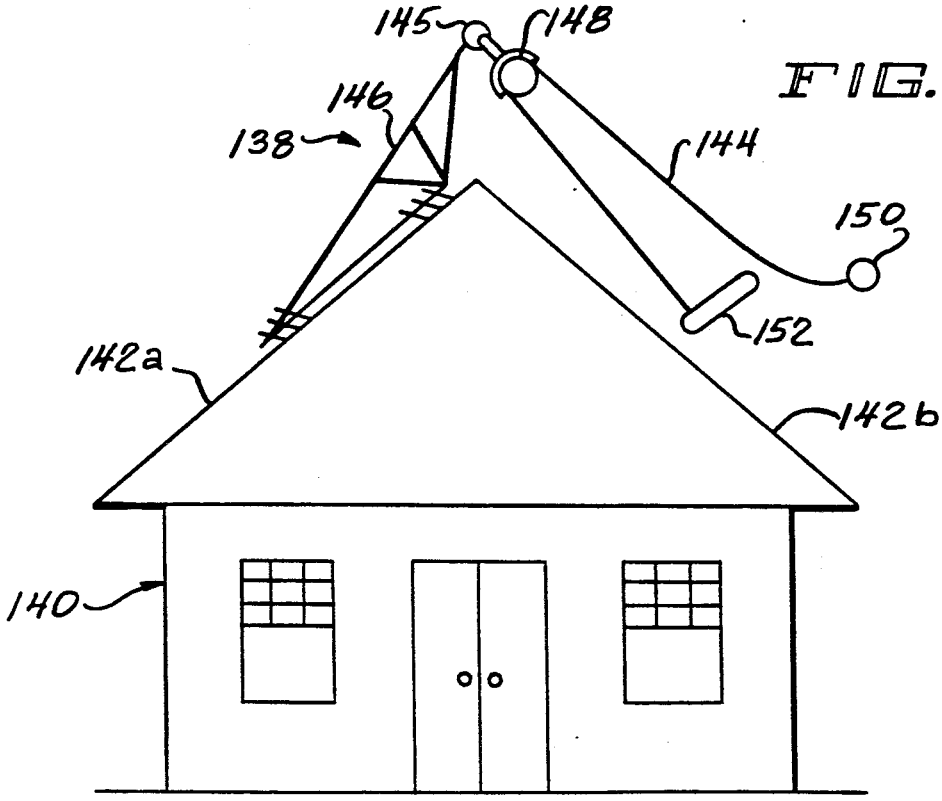
FIG. 8 is a simplified schematic diagram of a roof-mounted cable restraining arrangement for use with the roof shingle removing apparatus of the present invention.

Referring to FIG. 8, there is shown in simplified schematic diagram form an operator/shingle remover restraining system 138 for use with the roof shingle remover of the present invention. The restraining system 138 is adapted for use on inclined roof sections 142*a* and 142*b* of a structure, or building, 140. The restraining system 138 includes a plurality of jacks 146 securely attached to a first inclined roof section 142*a* by conventional means such as nails or threaded fasteners. The jacks 146, only one of which is shown in the figure for simplicity, are positioned in a spaced manner along a length of the roof and are coupled at respective upper ends thereof by means of a cable 145. Attached to and suspended from the cable 146 is a pulley 148 having a cable 144 suspended therefrom. Attached to one end of the cable 144 is a safety belt 152, while attached to a second end of the cable is a loop coupler 150. The loop coupler 150 is adapted for attachment to a handle-mounted connecting loop previously described and illustrated in FIGS. 1 and 4. A safety belt 152 is adapted for positioning about the waist of an operator of a roof shingle remover such as shown in FIGS. 1–5. The safety belt 152 attached to the roof shingle remover operator prevents the operator from falling off the inclined roof section 142*b*, while the loop coupler 150 attached to the shingle remover prevents the shingle remover from slipping off of the inclined roof section. The jacks 146 are securely attached to the opposing side of the inclined roof from which the shingles are being removed.

There has thus been shown a roof shingle remover which includes a motor-driven, reciprocally operated cutting blade adapted for insertion beneath the shingles for severing the shingle attachment means. The severing blade is mounted in a forward, lower portion of a movable frame which may be either pushed or motor drive. Disposed immediately above the severing blade and on a forward portion of the structural frame is a deflector for collecting the thus removed shingles and pushing them off of the roof. The roof shingle remover may be either in the form of a lightweight, portable, hand-held unit, or may be in the form of a larger, tractor-type vehicle on which the operator rides for larger shingle removing jobs. An operator and roof shingle remover restraining system prevents either the shingle removing apparatus or an operator from falling off an inclinded roof.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. Apparatus for removing shingles affixed to a roof by attaching means, said apparatus comprising:

a frame;

a handle coupled to said frame for facilitating manually displacing said apparatus;

severing means including an elongated, linear blade movably coupled to a lower, forward portion of said frame;

displacement means coupled to said severing means for displacing said blade in a linearly reciprocating manner along the length thereof in a direction generally transverse to the direction of displacement of the apparatus and cutting said attaching means in loosening the shingles from the roof; and deflector means coupled to said frame and disposed immediately above said severing means for engaging and urging the thus loosened shingles forward of said frame as the apparatus is displaced over the roof.

2. The apparatus of claim 1 wherein said frame includes lower structural members engaging the roof to facilitate displacement of the apparatus over the roof in a sliding manner.

3. The apparatus of claim 1 further comprising wheels attached to said frame to facilitate displacement of the apparatus.

4. The apparatus of claim 3 further comprising drive means coupled to a wheel for displacing the apparatus.

5. The apparatus of claim 4 wherein said drive means includes a gasoline motor.

6. The apparatus of claim 4 wherein said drive means includes an electric motor.

7. The apparatus of claim 4 further comprising a sprocket and drive chain arrangement for coupling said drive means to a wheel.

8. The apparatus of claim 1 wherein said frame includes an elongated, linear channel for receiving and supporting said blade.

9. The apparatus of claim 8 wherein said displacement means includes a reciprocating motor coupled to said blade for displacing said blade in a reciprocating manner along the length thereof within said channel in a direction generally transverse to the direction of displacement of the apparatus.

10. The apparatus of claim 9 wherein said reciprocating motor is gas powered.

11. The apparatus of claim 9 wherein said reciprocating motor is an electric motor.

12. The apparatus of claim 1 further comprising first and second cutting elements disposed adjacent respective ends of said deflector means for cutting shingles loosened from the roof.

13. The apparatus of claim 1 wherein said deflector means includes a generally concave, upward extending member attached to a forward portion of said frame.

14. The apparatus of claim 1 further comprising adjustable coupling means for coupling said handle to said frame for allowing the position of said handle relative to said frame to be adjusted.

15. The apparatus of claim 14 wherein said adjustable coupling means includes a pivot pin pivotally coupling an end of said handle to said frame and an apertured bracket and positioning pin combination for adjusting the position of said handle.

16. The apparatus of claim 1 further comprising restraining means coupled to the apparatus and to an operator of the apparatus for preventing either the operator or the apparatus from falling from the roof.

17. The apparatus of claim 16 wherein said restraining means includes one or more jacks attached to the roof, a pulley attached to said one or more jacks, and a cable attached to the apparatus and to an operator.

18. The apparatus of claim 17 wherein the apparatus and operator are positioned on a first inclined portion of a roof and said one or more jacks are attached to a second, inclined, opposed portion of the roof.

19. The apparatus of claim 18 wherein a first end of said cable is attached to the apparatus and a second end of the cable is attached to the operator.

20. Apparatus for removing shingles affixed to a roof by attaching means, said apparatus comprising:

a self-propelled vehicle having means for supporting an operator thereon;

platform means coupled to said vehicle and moveable between upper and lower positions;

linearly reciprocating cutting means disposed on a forward, lower portion of said platform means and displaced in a direction generally transverse to a direction of travel of said vehicle for severing the attaching means and loosening the shingles from the roof;

deflector means disposed on a forward portion of said platform means immediately above said cutting means for engaging and urging the thus loosened shingles forward of said vehicle as said vehicle moves over the roof; and control means for lowering said platform means between an operating position wherein said cutting means engages the shingles and a storage position wherein said cutting means is positioned above the shingles.

21. Apparatus for removing a surface layer from a generally flat surface, wherein attachment means is disposed intermediate said surface layer and said flat surface for securing said surface layer to said flat surface, said apparatus comprising:

a frame disposed on and movable over the flat surface;

elongated, generally flat cutting means disposed on a lower portion of said frame for positioni. g intermediate the surface layer and the flat surface for engaging said attachment means;

drive means coupled to said cutting means for displacing said cutting means in a linearly reciprocating manner generally transverse to the direction of displacement of said frame and parallel to and in closely spaced relation to the flat surface for severing said attachment means and removing the surface layer from the flat surface as said frame is displaced over the flat surface; and deflector means attached to said frame adjacent to said cutting means for deflecting the surface layer away from said frame following removal of the surface layer from the flat surface.

22. The apparatus of claim 21, wherein said elongated, generally flat cutting means includes a blade having a plurality of spaced teeth on a leading edge thereof.

23. The apparatus of claim 22, wherein said blade is disposed immediately adjacent to a forward, lower edge portion of said deflector means.

24. The apparatus of claim 21, wherein said deflector means extends upward from said cutting means and is attached to a forward portion of said frame.

25. The apparatus of claim 24, wherein said deflector means includes an upwardly extending deflector plate having a concave portion facing in the direction of displacement of said frame and a forward, lower edge adjacent to the flat surface for engaging and urging the surface layer away from the flat surface.

26. The apparatus of claim 21, wherein said drive means includes a motor.

27. The apparatus of claim 26, wherein said motor is gasoline powered.

28. The apparatus of claim 26, wherein said motor is electrically driven.

29. The apparatus of claim 26, wherein said motor is hydraulically actuated.

30. The apparatus of claim 21, further comprising handle means coupled to said frame for facilitating manual displacement of the apparatus over the flat surface.

31. The apparatus of claim 30, further comprising skid means disposed on a lower portion of said frame for supporting said frame on and facilitating displacement of the apparatus over the flat surface.

32. The apparatus of claim 30, further comprising a plurality of wheels coupled to said frame for facilitating displacement of the apparatus over the flat surface.

33. The apparatus of claim 21, further comprising severing means disposed adjacent to an end of said cutting means for cutting and forming the surface layer into a strip following its removal from the flat surface.

34. The apparatus of claim 33, wherein said severing means includes a fixed severing blade disposed adjacent to an end of said cutting means.

35. The apparatus of claim 33, wherein said severing means includes first and second severing blades disposed adjacent to respective ends of said cutting means.

36. The apparatus of claim 21, further comprising displacement means for moving the apparatus over the flat surface.

37. The apparatus of claim 36 further comprising wheels mounted to said frame and coupled to said displacement means.

38. The apparatus of claim 37, wherein said displacement means includes a gasoline powered motor.

39. The apparatus of claim 37, wherein said displacement means includes an electrically driven motor.

40. The apparatus of claim 37, wherein said displacement means includes a hydraulically driven motor.

* * * * *